US009850044B2

(12) United States Patent
Mühlemann

(10) Patent No.: US 9,850,044 B2
(45) Date of Patent: Dec. 26, 2017

(54) PLASTIC CLOSURE HAVING AN INTEGRITY GUARANTEE ELEMENT

(71) Applicant: FOSTAG Formenbau AG, Stein am Rhein (CH)

(72) Inventor: Rolf Mühlemann, Schlattingen (CH)

(73) Assignee: FOSTAG FORMENBAU AG, Stein am Rhein (CH)

( * ) Notice: Subject to any disclaimer, the term of this patent is extended or adjusted under 35 U.S.C. 154(b) by 74 days.

(21) Appl. No.: 14/774,634

(22) PCT Filed: Feb. 18, 2014

(86) PCT No.: PCT/EP2014/053127
§ 371 (c)(1),
(2) Date: Sep. 10, 2015

(87) PCT Pub. No.: WO2014/139767
PCT Pub. Date: Sep. 18, 2014

(65) Prior Publication Data

US 2016/0016703 A1 Jan. 21, 2016

(30) Foreign Application Priority Data

Mar. 12, 2013 (CH) ..... 583/13

(51) Int. Cl.
*B65D 47/08* (2006.01)
*B65D 41/06* (2006.01)
(Continued)

(52) U.S. Cl.
CPC ..... *B65D 47/08* (2013.01); *B65D 41/06* (2013.01); *B65D 41/3428* (2013.01);
(Continued)

(58) Field of Classification Search
CPC .... B65D 41/62; B65D 41/3428; B65D 47/08; B65D 47/0814; B65D 47/0833;
(Continued)

(56) References Cited

U.S. PATENT DOCUMENTS 5,069,367 A * 12/1991 Salmon ..... B65D 47/0838 215/235
5,141,138 A * 8/1992 Odet ..... B65D 47/40 215/235
(Continued)

FOREIGN PATENT DOCUMENTS

EP 0 531 887 A2 3/1993

*Primary Examiner* — Paul R Durand
*Assistant Examiner* — Andrew P Bainbridge
(74) *Attorney, Agent, or Firm* — DWC Law Firm, P.S.; Ann W. Speckman; David Chen

(57) ABSTRACT

In order to prevent or minimize littering, the invention proposes a plastic closure (1) having a tamper-proof element. The plastic closure has a tamper-proof element that is as small as possible, and the plastic closure is largely secured against loss. The tamper-proof element consists of a plate (50), which is formed as part of the jacket wall (30) of the cover (3) by means of designed breaking point bridges (51, 52) and lies behind a first apron (25) in the closed state before the first opening and engages in a window (26) of the first apron by means of a locking hook. After the first opening, the plate (50) is separated from the cover and is held captive between the first apron (25) and a second, inner apron (27).

9 Claims, 2 Drawing Sheets

(51) Int. Cl.
*B65D 41/34* (2006.01)
*B65D 41/62* (2006.01)

(52) U.S. Cl.
CPC ..... *B65D 41/62* (2013.01); *B65D 47/0814* (2013.01); *B65D 47/0833* (2013.01); *B65D 47/0804* (2013.01); *B65D 47/089* (2013.01); *B65D 47/0838* (2013.01); *B65D 47/0847* (2013.01); *B65D 2101/003* (2013.01); *B65D 2101/0023* (2013.01); *B65D 2101/0084* (2013.01)

(58) Field of Classification Search
CPC ..... B65D 47/0838; B65D 47/0847; B65D 47/0804; B65D 47/089
USPC ..... 222/153.05–153.06, 531–537, 222/541.5–541.6, 544–547, 567, 570, 222/556; 215/235–245, 253, 256; 220/254.1–254.9
See application file for complete search history.

(56) References Cited

U.S. PATENT DOCUMENTS

| | | | | |
|---|---|---|---|---|
| 6,405,885 | B1 * | 6/2002 | Elliott | B65D 47/0838 215/237 |
| 6,976,607 | B2 * | 12/2005 | Benoit-Gonin | B65D 47/0838 222/153.06 |
| 8,590,734 | B2 * | 11/2013 | Giraud | B65D 50/045 215/204 |
| 2004/0069806 | A1 * | 4/2004 | Benoit-Gonin | B65D 47/0838 222/153.06 |
| 2005/0173367 | A1 * | 8/2005 | Nusbaum | B65D 47/0828 215/237 |
| 2006/0043052 | A1 * | 3/2006 | Lin | B65D 47/0838 215/253 |
| 2007/0102390 | A1 * | 5/2007 | Hoepner | B65D 47/0885 215/235 |
| 2009/0152269 | A1 * | 6/2009 | Pucci | B65D 47/0823 220/254.3 |
| 2011/0163135 | A1 * | 7/2011 | Herald | B65D 47/0876 222/556 |

* cited by examiner

PLASTIC CLOSURE HAVING AN INTEGRITY GUARANTEE ELEMENT

REFERENCE TO RELATED APPLICATIONS

This application is the US national phase entry of International Patent Application no. PCT/EP2014/053127, filed Feb. 18, 2014, which claims priority to Swiss patent application no. 00583/13, filed Mar. 12, 2013.

TECHNICAL FIELD

The present invention relates to a plastic closure having a lower part with a drinking spout and a cover which is connected in one piece to the lower part by means of a hinge, and comprises a sealing plug which can be engaged in a locking manner with the drinking spout, said sealing plug being molded on the inner side of the cover surface, wherein the lower part and the cover each comprise a jacket wall, which are at least approximately flush one above the other in the closed state of the plastic closure, and that the plastic closure also comprises at least one integrity guarantee element, which is separable during the first opening of the plastic closure due to the swiveling motion of the cover relative to the lower part.

BACKGROUND

Plastic closures, which comprise a lower part and a cover connected thereto in a swiveling manner by means of a hinge, have to be secured in such a way that the consumer recognizes whether the closure may have already been opened before the purchase and whether there is therefore the risk of the contents already having been partially removed or, something which unfortunately also occurs, having been contaminated.

Accordingly, plastic closures having integrity guarantee elements have already been on the market for very many years. The best known form of an integrity guarantee element is the guarantee band, which originally primarily produced a connection between the plastic closure and the container on which the plastic closure is fitted. Such a guarantee band is of course sufficient in the case of a screw connection. Such a guarantee band can also be used in the case of plastic closures with a hinge or a snap-on hinge with which the lower part can be fixedly connected to the container neck, wherein such a guarantee band is usually not completely circumferential, but runs around more than 180° of the circumference. The guarantee band then comprises locking hooks usually on the inner side, i.e. on the side that is directed towards the lower part in the closed state, said locking hooks engaging in the corresponding recesses in the lower part. Before such a closure can be opened, the guarantee band must therefore first to be torn off.

For reasons of user convenience, integrity guarantee elements were then developed which, when the hinge connection is first opened, automatically bring about a separation of the integrity guarantee element from the part to which this integrity guarantee element is connected by predetermined breaking points. Such a plastic closure is shown for example in WO94/03371. Here, a platelet is held by predetermined breaking point bridges in the cover in its cover surface flush with said cover surface, and molded on the underside of said platelet is an arm with a terminal locking hook, which interconnects with a counter-locking hook of the lower part. During the first opening, the platelet of the integrity guarantee element is duly torn out of the cover surface of the cover and then falls down onto the cover surface of the lower part. A clearly visible integrity guarantee thus results. In addition, such a solution has the advantage that, after the first opening, tampering with the integrity guarantee element more or less to recreate the integrity state is virtually impossible.

WO00/41943 shows a solution for an integrity guarantee element that is also difficult to tamper with. Here, the integrity guarantee element comprises a completely separate guarantee band, which engages over protruding beads on the cover and the lower part. Such a solution has the advantage that the guarantee band can be constituted in a different color from the plastic closure itself, and thus can be readily recognized visually. Here, as in the solutions for integrity guarantee elements in common use nowadays, the separated parts are relatively large and, precisely in the case of beverages which are provided with a plastic closure with a drinking spout, these integrity guarantee elements are torn off and thrown away carelessly.

A solution, wherein the integrity guarantee element is not a separate loose part, is shown for example in GB-A-2269583. Here, the plastic closure is provided with a shield-shaped tilting plate which hooks on the lower part in a swiveling manner. This shield-shaped plate is pressed for the purpose of opening and a predetermined breaking point bridge is thereby destroyed. The closure can now be opened. The problem with this solution, however, is that the consumer can scarcely recognize the integrity of the product.

Finally, a plastic closure is known from WO98/57864, according to the preamble of patent claim 1. This plastic closure comprises an integrity guarantee element which is molded on the jacket wall of the cover and which is intended to engage in a recess in the jacket wall of the lower part. The integrity guarantee element swivels here about the predetermined breaking points and comprises two lugs, which are intended to engage in corresponding holes in the jacket wall of the lower part. In addition, a tilting rib is formed in the recess in the lower part and the user is intended to press on the integrity guarantee element, wherein the tilting motion is intended to take place via the tilting rib, and the integrity guarantee element is thereby separated from the cover. The closure can now be swiveled upwards. This closure is problematic, inasmuch as on the one hand the user does not recognize the function and basically attempts to lift the integrity guarantee element. Furthermore, a swiveling motion about an arc-shaped hinge is extremely problematic and finally it has been shown that such a closure can be handled only with extreme difficulty on conventional assembly machines, and that a significant percentage of the closures are destroyed. On the other hand, the idea that the integrity guarantee element remains on the closure and is not therefore thrown away carelessly is in itself sensible.

SUMMARY

It is the problem of the present invention to improve a plastic closure of the type mentioned at the outset in such a way that the latter is capable of being closed in a conventional manner in standard assembly machines with a low level of rejects, the destruction of the first opening guarantee closure is more readily recognizable, and finally in a preferred embodiment the at least one integrity guarantee element is also held in such a way that it is secured sufficiently in the plastic closure against loss.

This problem is solved by a plastic closure having a lower part with a drinking spout and a cover which is connected in one piece to the lower part by means of a hinge and comprises a sealing plug which can be engaged in a locking manner with the drinking spout, said sealing plug being molded on the inner side of the cover surface wherein the lower part and the cover each comprise a jacket wall, which stand at least approximately flush one above the other in the closed state of the plastic closure, and that the plastic closure also comprises at least one integrity guarantee element, characterized in that the cover jacket wall is provided with at least one locking hook molded on the outer side opposite the hinge, and a first apron directed towards the cover and extending over less than half the circumference is provided on the lower part opposite the hinge and above the jacket wall of the lower part, in which first apron at least one hook locking window is formed, and a second apron running concentric with the first apron is provided, which second apron is offset inwards by at least the thickness of the jacket wall of the cover in this region, and wherein the at least one integrity guarantee element, which is separable during the first opening of the plastic closure by the swiveling motion of the cover relative to the lower part, is a partial region of the jacket wall of the cover and is provided with the at least one mentioned locking hook.

BRIEF DESCRIPTION OF THE DRAWINGS

A preferred embodiment of the subject-matter of the invention is represented in the drawing and explained in the following description. In the figures.

DETAILED DESCRIPTION

Figure 1:
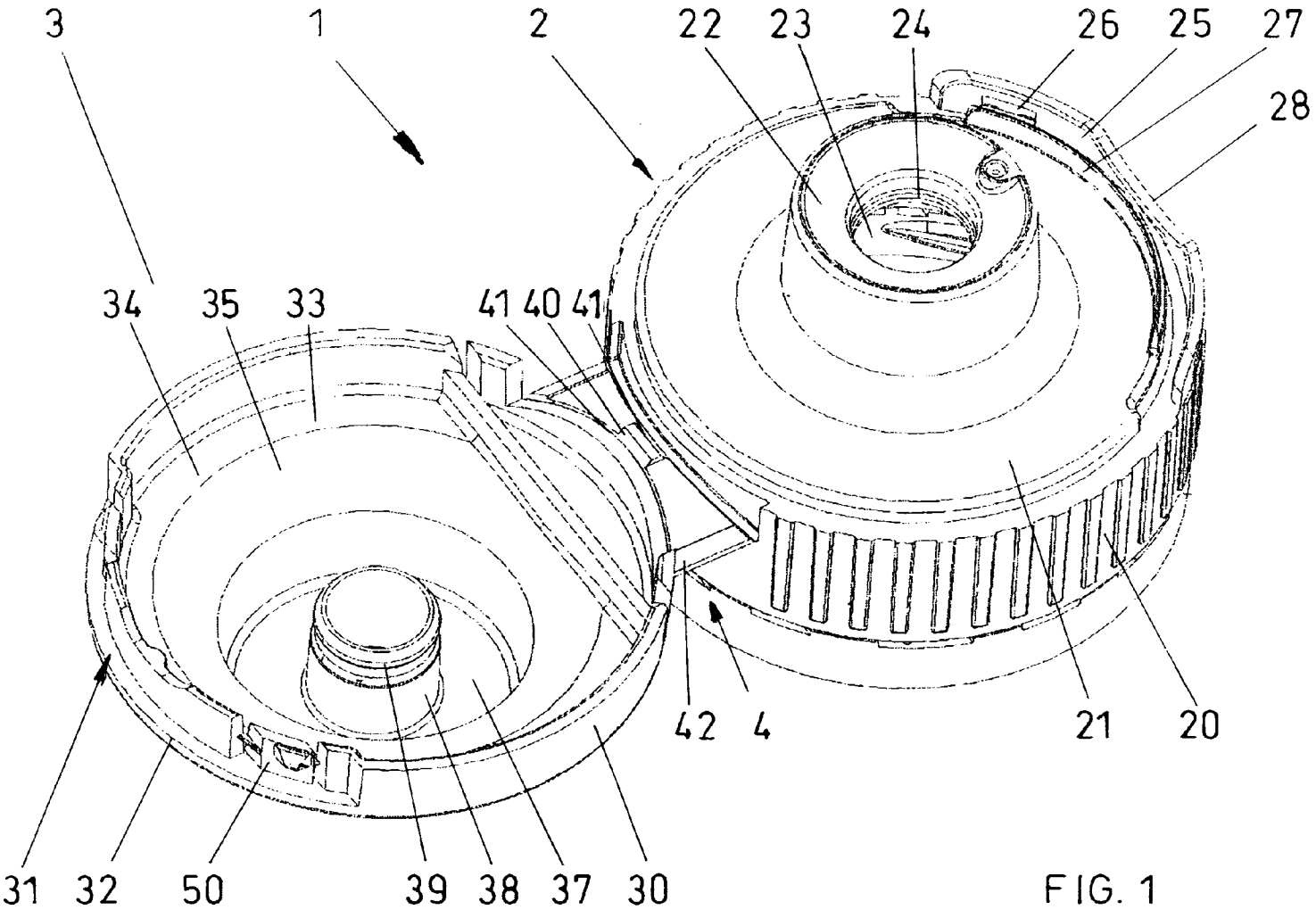
FIG. 1 shows a perspective view of the plastic closure in the opened production position.

The plastic closure is denoted overall by 1. It comprises a lower part 2 and a cover 3. Lower part 2 and cover 3 are connected to one another in one piece by a hinge 4. The hinge comprises, on the one hand, a hinge piece 40, which is connected on both sides by a film hinge 41 on the one hand to cover 3 and on the other hand to lower part 2. Two tension bands 42 are provided symmetrical with this hinge piece 40. The effect of this is that the hinge is a snap-on hinge.

Lower part 2 comprises a cylindrical jacket wall 20, which is terminated on the upper side by a cover surface 21. A drinking spout 22 passes through this cover surface 21. This drinking spout 22 projects beyond cover surface 21 roughly by the height of jacket wall 20. In order to provide sufficient drinking convenience, the drinking spout should preferably project at least overall with its uppermost edge approx. 10 mm or more above cover surface 21. The embodiment of the spout can be almost arbitrary. In the example represented here, the drinking spout tapers upwards with a certain conicity. However, the drinking spout can also perfectly well have the shape of a dummy. The relatively widespread shapes on the market, wherein the drinking spout is tapered at half the height, also of course come into consideration here. Drinking opening 23 can be seen at the top in drinking spout 22. The drinking opening is limited by a pulled-down collar, which comprises circumferential sealing ribs 24 on its inner side.

An arc-shaped, first apron 25 stands above jacket wall 20 of lower part 2 virtually in the extension thereof. Said apron is connected over the whole area and in one piece to jacket wall 20. First apron 25 extends over less than half the circumference of jacket wall 20 of lower part 2 and its center lies diametrically opposite hinge piece 40 of hinge 4. The height of the apron amounts to only a few millimeters and is at most roughly a third as high as drinking spout 22. First apron 25 is provided with a recessed portion roughly in the middle on the upper edge, said recessed portion forming a grip recess 28. Two hook locking windows 26 are molded here in first apron 25 at the side of this grip recess 28. Said hook locking windows are rectangular perforations in first apron 25. In principle, only one hook locking window could also be provided in the center instead of the two hook locking windows 26. However, since the grip recess here is provided in this region, the remaining wall height is rather small and it is therefore preferable to provide the two hook locking windows 26 at the side.

A second, inner apron 27 is provided concentric with first apron 25. The significance and mode of operation of said second, inner apron will be explained in greater detail later. This second, inner apron 27 is preferably at most equal in height to the outer apron, but preferably lower than outer, first apron 25. It is also preferably constituted with a somewhat smaller length than outer, first apron 25.

Cover 3 also has a circumferential jacket wall 30. This jacket wall 30 comprises a jacket wall region 31, which lies diametrically opposite hinge 4 and which is disposed offset inwards towards the center with respect to edge 32 by slightly more than the wall thickness of first apron 25 on lower part 2. Since the closure is represented here in the opened state, only the inner side of cover surface 33 of cover 3 can be seen. Cover surface 33 has an outer, roughly flat region 34, which is followed by a cover surface region 35 running inclined conically upwards.

Finally, a cover surface part directed cylindrically upwards then follows, having at the top a flat termination 37. Molded on the inner side of this flat termination 37 is a sealing plug 38, which comprises circumferential sealing beads 39 on its outer side. These sealing beads 39 on sealing plug 38 co-operate in the closed state of the closure with circumferential sealing ribs 24 in drinking spout 22. The integrity guarantee element according to the invention comprises a plate 50, which is part of jacket wall region 31. This plate 50 is completely separated from jacket wall region 31 apart from lateral predetermined breaking point bridges 51 and upper predetermined breaking point bridge 52. The two lateral predetermined breaking point bridges 51 form the connection between mentioned plate 50 and laterally adjacent jacket wall region 31 which is offset inwards with respect to edge 32. A third upper predetermined breaking point bridge 52 forms the connection between mentioned plate 50 and flat cover surface part 34 of cover 3. Preferably only three such predetermined breaking point bridges are present, but it is perfectly conceivable also to provide more than just three predetermined breaking point bridges, but which then have to be constituted thinner in order that the forces required for the first opening are kept within limits, in such a way that the user can open the closure without using excessive force.

Figure 2:
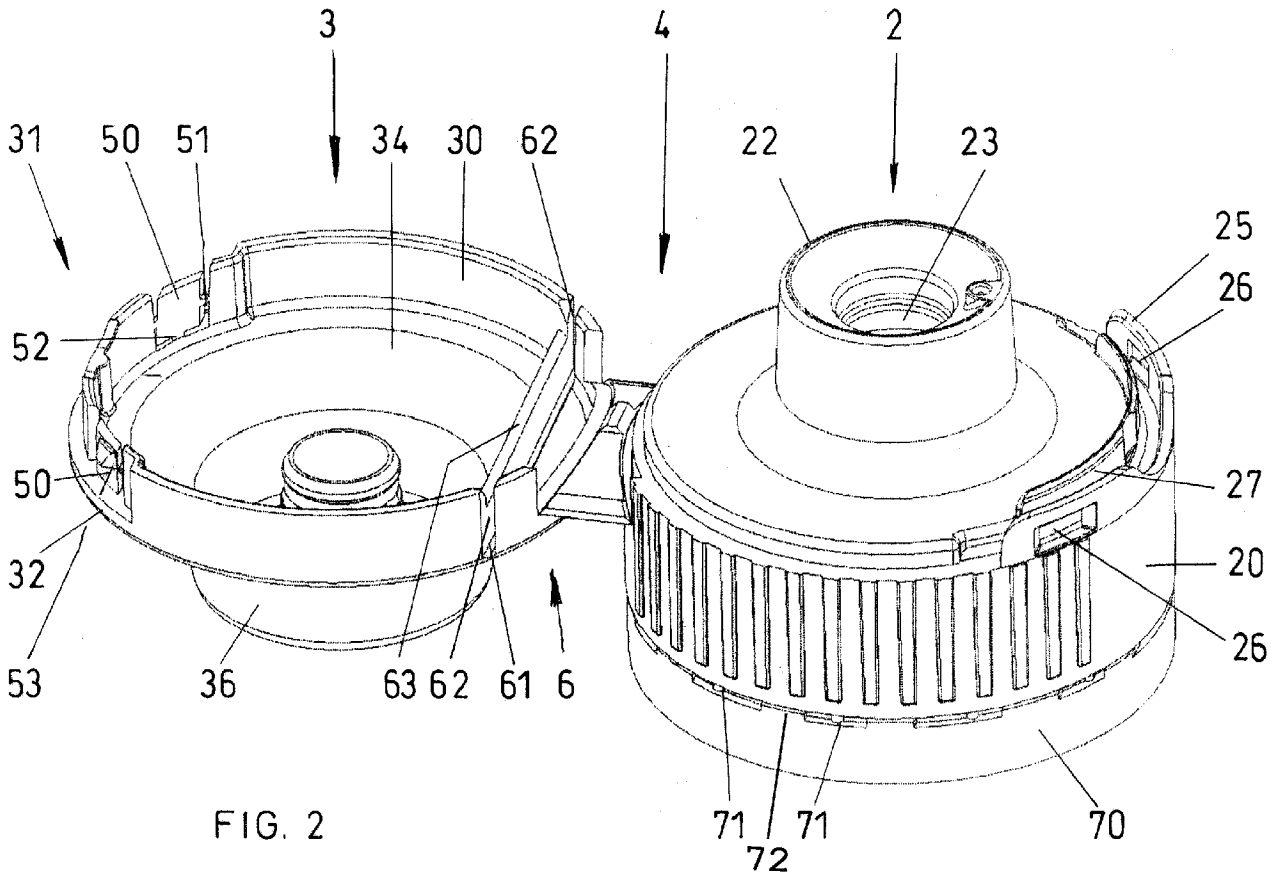
FIG. 2 shows the same closure again in a perspective view, viewed somewhat rotated and more from the side compared to FIG. 1.

A locking hook 53 is integrally molded on the outer side of plate 50 lying remote from the center. This locking hook engages, in the closed state of the closure, in a hook locking window 26 of first, outer apron 25 on lower part 2. As described above, two such integrity guarantee elements are preferably present. Thus, as can be seen in FIG. 2, two plates 50 can be seen, which can engage with their externally fitted locking hooks 53 in two hook locking windows 26.

The function of first, outer apron 25 is of course to form, in particular, a counterpart to separable plates 50 with locking hook 53 on cover 3. First apron 25, however, at the same time forms a screen in order to cover jacket wall region 31 of cover 3 that is offset towards the center. Windows 26 are constituted larger than the width and height of locking hooks 53. The user thus still has a view of plate 50 or locking hook 53.

Shorter apron 27 running closer to the center and concentric with the first apron has other functions. On the one hand, it serves to ensure that inwardly offset jacket wall region 31 is guided precisely into position during the mechanical first closing, and that locking hooks 53 on plates 50 are guided exactly in front of hook locking windows 26 and are displaced there to an extent such that locking hooks 53 engage through these hook locking windows 26. At the same time, however, this inner apron prevents tampering with the integrity guarantee element. Plates 50 cannot therefore be shifted from the outside inwards, so that the locking hooks would no longer be engaged with the hook locking windows. The integrity guarantee element can therefore only be destroyed by the closure being opened, i.e. by cover 3 being rotated relative to lower part 2 about hinge 4. When such a first opening is carried out, mentioned lateral predetermined breaking point bridges 51 and upper predetermined breaking point bridge 52 are destroyed and plate 50 is completely separated from jacket wall region 31 of cover 3 that is offset towards the center. Plates 50 thus separated remain captured between first, outer apron 25 and second, inner apron 27. After the first opening, separated plates 50 are able to slip out laterally between the two aprons 25 and 27. When the closure is closed again, cover 3 is held to lower part 2 by sealing plug 38 in drinking spout 22. The view through hook locking windows 26 is now free. If the closure is produced in two colors by means of a coaxial mold, i.e. for example lower part 2 in green and the cover in orange, the orange-colored locking hooks 53 or plates 50 are seen before the first opening and, after the first opening, the green part of inner apron 27 is seen through the same hook locking windows, whereas the orange part of plate 50 is absent.

In order to enhance the drinking convenience of plastic closure 1, a segment 6 of cover 3 is present above a film hinge 61, which runs in the flat cover surface part and which separates segment 6 from the remaining cover with a swiveling motion. Jacket wall 30 of cover 3 accordingly comprises lateral slits 62 and, for reasons of hygiene, a partition wall 63 runs from first slit 62 to opposite-running slit 62', said partition wall lying, in the closed state of the closure, at least approximately on the flat region of cover surface 21 of lower part 2. This allows the user to swivel this cover part and the film hinge away from the spout by using his finger when drinking, so that the latter is not in the way during drinking.

Lower part 2 is also connected at the lower edge of jacket wall 20 to a securing ring 70 by means of securing ring predetermined breaking point bridges 71. A support elevation 72 is provided between two adjacent securing ring predetermined breaking point bridges 71 in each case, and the securing point predetermined breaking point bridges 71 are longer than the support elevation 72, which projects above the upper edge of the securing ring 70. This securing ring 70 allows the closed closure to be easily pressed on a container. For this purpose, retaining beads pointing inwards are molded on the inner side, not visible in the drawing, said retaining beads being able to be engaged with a circumferential retaining bead on the container neck. This therefore also ensures that closure 1 cannot be removed in the closed state from the container neck and subsequently be emptied undetected. When predetermined breaking point bridges 70 are destroyed, securing ring 70 slips to a lower level and a purchaser thus clearly recognizes that the container has already been opened.

This detectability of the first opening can be improved still further by spraying plate 50 in a different color from the rest of the closure, or by the fact that lower part 2 is sprayed in one color and cover 3 in another color. This can also be achieved with a one-piece closure by means of so-called coaxial injection molding.

REFERENCE LIST

1 plastic closure
2 lower part
3 cover
4 hinge
6 segment of cover 3
40 hinge piece
41 film hinge
42 tension bands
20 jacket wall of lower part
21 cover surface of lower part
22 drinking spout
23 drinking opening
24 sealing lips in drinking spout
25 first apron
26 hook locking window
27 second inner apron
28 grip recess
30 jacket wall of cover
31 jacket wall region
32 edge of cover surface
33 cover surface of cover
34 flat cover surface part
35 cover surface region directed conically upwards
36 cylindrical cover surface part
37 flat termination
38 sealing plug
39 sealing beads
50 plate
51 lateral predetermined breaking point bridges
52 upper predetermined breaking point bridges
53 locking hook
61 film hinge
62 slits
70 securing ring
71 predetermined breaking point bridges

The invention claimed is:

1. A plastic closure having a lower part with a drinking spout and a cover which is connected in one piece to the lower part by means of a hinge and comprises a sealing plug which can be engaged in a locking manner with the drinking spout, said sealing plug being molded on the inner side of a cover surface, wherein the lower part and the cover each comprise a jacket wall, which stand at least approximately flush one above the other in a closed state of the plastic closure, and wherein the plastic closure further comprises at least one integrity guarantee element, and wherein the cover jacket wall is provided with at least one locking hook molded on the outer side opposite the hinge, and a first apron directed towards the cover and extending over less than half the circumference is provided on the lower part opposite the hinge and above the jacket wall of the lower part, in which first apron at least one hook locking window is formed, and a second apron running concentric with the first apron is provided, which second apron is offset inwards by at least the thickness of the jacket wall of the cover in this region, and wherein the at least one integrity guarantee element, which is separable during the first opening of the plastic closure by a rotating motion of the cover relative to the lower part, is a partial region of the jacket wall of the cover and is provided with the at least one locking hook, wherein the integrity guarantee element is completely separated from the jacket wall apart from securing ring predetermined breaking point bridges, and wherein the integrity guarantee element has the shape of a rectangular plate and is at most of equal height to the cover jacket wall, wherein a predetermined lateral breaking point bridge in each case forms the connection to the laterally adjacent cover jacket wall at least at the lateral edges of the integrity guarantee element.

2. The plastic closure according to claim 1, wherein the integrity guarantee element comprises an upper predetermined breaking point bridge, which is connected to the cover jacket wall between each adjacent lateral predetermined breaking point bridge.

3. The plastic closure according to claim 1, wherein two integrity guarantee elements are disposed symmetrical to a traversing diagonal running through the hinge.

4. The plastic closure according to claim 1, wherein the distance between the first and the second concentrically running apron is greater than the wall thickness of the at least one integrity guarantee element, but less than said wall thickness in the region of the locking hooks.

5. The plastic closure according to claim 1, wherein the jacket wall of the cover is slit up to the adjacent cover surface, forming two slits, and the remaining jacket wall region between the two slits is connected to the hinge, and wherein the connecting line between the two slits is constituted as film hinge in the cover surface.

6. The plastic closure according to claim 5, wherein a connecting wall is formed adjacent to the slits on the side towards the center of the cover, said connecting wall supplementing the remaining jacket wall on the side lying remote from the hinge.

7. The plastic closure according to claim 1, wherein the jacket wall of the lower part is provided with an inner thread and a closed securing ring is formed flush beneath this jacket wall, wherein the securing ring is connected in one piece by the securing ring predetermined breaking points to the jacket wall of the lower part and is provided on its inner surface with retaining means for the connection to a container neck.

8. The plastic closure according to claim 7, wherein a support elevation is provided between each adjacent securine ring predetermined breaking point bridge, and wherein the securing ring predetermined breaking point bridges are longer than the support elevation which projects above the upper edge of the securing ring.

9. The plastic closure according to claim 1, wherein the cover surface of the cover is raised concentrically with a corresponding shape corresponding to the drinking spout of the lower part.

* * * * *